US005208579A

United States Patent [19]

Tseng

[11] Patent Number: 5,208,579

[45] Date of Patent: May 4, 1993

[54] ALARM SYSTEM

[76] Inventor: Chiang S. Tseng, 9780 Capella Drive, Richmond, British Columbia, Canada, V6X3N4

[21] Appl. No.: 694,825

[22] Filed: May 2, 1991

Related U.S. Application Data

[63] Continuation-in-part of Ser. No. 691,367, Apr. 25, 1991.

[51] Int. Cl.[5] ..... E05B 45/06; H01H 27/06; G08B 19/00

[52] U.S. Cl. ..... 340/542; 70/419; 70/DIG. 49; 200/61.66; 340/521

[58] Field of Search ..... 340/542, 521; 70/DIG. 49, 419, 441; 200/61.66–61.68, 252, 260, 336, 273–274

[56] References Cited

U.S. PATENT DOCUMENTS

| | | | |
|---|---|---|---|
| 3,596,014 | 7/1971 | Erez | 340/542 X |
| 3,986,376 | 10/1976 | Lack | 70/419 X |
| 4,186,578 | 2/1980 | Sommer | 70/419 |
| 4,205,542 | 6/1980 | Renda | 70/441 X |
| 4,262,506 | 4/1981 | Töbel | 70/419 |
| 4,845,471 | 7/1989 | Chu | 340/542 |
| 5,041,814 | 8/1991 | Lin | 340/542 |

*Primary Examiner*—Thomas Mullen
*Attorney, Agent, or Firm*—Rosenblum, Parish & Isaacs

[57] ABSTRACT

An improved alarm system having a first electrode carried by at least one of the locking elements and a second electrode carried by the locking surface normally engageable by the locking elements when the locking mechanism is in its locked configuration, and an alarm system including an alarm signal generator and a plurality of event detection sensors, one of which is formed by the first and second locking elements, the sensors being coupled to the signal generator such that an event detected by any sensor causes the generator to develop an alarm signal.

11 Claims, 6 Drawing Sheets

ALARM SYSTEM

This application is a continuation-in-part of my copending application Ser. No. 07/691,367 filed Apr. 25, 1991 and entitled "Anti-Tamper Locking Mechanism".

BACKGROUND OF THE INVENTION

1. Field of the Invention

The present invention relates generally to alarm systems and more particularly to an improved locking mechanism and associated alarm activation circuitry having means for detecting an attempted defeat of the lock by the turning of an unauthorized key or foreign object inserted into the key slot and for generating an alarm signal.

2. Brief Description of the Prior Art

Inexpensive locking devices including pin tumbler, wafer-tumbler, disk-tumbler and Bramah type locks of the types used in many auto and building alarm systems can be easily defeated by the manipulation of a properly constructed pick inserted into the locked keyway. Various means have thus heretofore been proposed to make it more difficult for such locks to be successfully opened by means other than a properly coded key. Furthermore, proposals have been made to distinguish between authorized and unauthorized objects inserted into the locked keyway for detecting a tamper attempt and providing a suitable response such as the activating of an alarm or the inhibiting of further lock movement.

One such approach is disclosed in the U.S. Pat. No. to Frederick A. Sommer (4,186,578) and includes the connection of an electrical circuit between two adjacent pin tumblers which are electrically insulated from the cylinder such that when the contacts are bridged by an electrical conductor such as a lock pick or the metal key, an electrical path is completed to produce the appropriate response to the tamper attempt. However, the problem with such apparatus is that it requires the use of a key made of plastic or other nonconductive material.

Another attempt to provide a means for detecting entry or drilling attempts into cylinder locks is disclosed in the U.S. Pat. No. to Tobel (4,262,506) and includes spring-biased tripping pins connected to an alarm or indicator system to detect a space in the rotated cylinder bore left unoccupied by insertion of an improperly made key or the removal of the cylinder. This approach has the disadvantage that it is only applicable to certain types of locks and does not provide a universal solution to the problem.

SUMMARY OF THE INVENTION

It is therefore a principal object of the present invention to provide a universal solution to the problem of detecting alarm system tampering from the very instant that the tamper attempt begins rather than after the system lock has been defeated.

Another object of the present invention is to provide a simple modification that can be made to any tumbler-type locking design to provide an instantaneous indication of a tamper attempt.

Briefly, a presently preferred embodiment of the present invention includes the provision of conductive electrodes positioned to be engaged by the tumblers of a lock associated with an alarm system in the event of an unauthorized attempt to open the lock or otherwise tamper with the system. An electrical circuit connected between the electrodes and the tumblers, or other conductive portions of the locking mechanism, activates a signal evidencing the attempted defeat of the lock. A lock cylinder or bolt actuated switch is provided to disable the alarm system if the right key is used to open the lock.

An important advantage of the present invention is that it can be applied to a wide variety of lock designs and requires only a minimal modification thereof.

Another advantage of the present invention is that it signals an attempted defeat as soon as any normal unlocking force is applied to the locking mechanism.

These and other objects and advantages of the present invention will no doubt become apparent to those skilled in the art after having read the following detailed description of the present invention disclosed in the several figures of the drawing.

IN THE DRAWING

DESCRIPTION OF THE PREFERRED EMBODIMENTS

Figure 1:
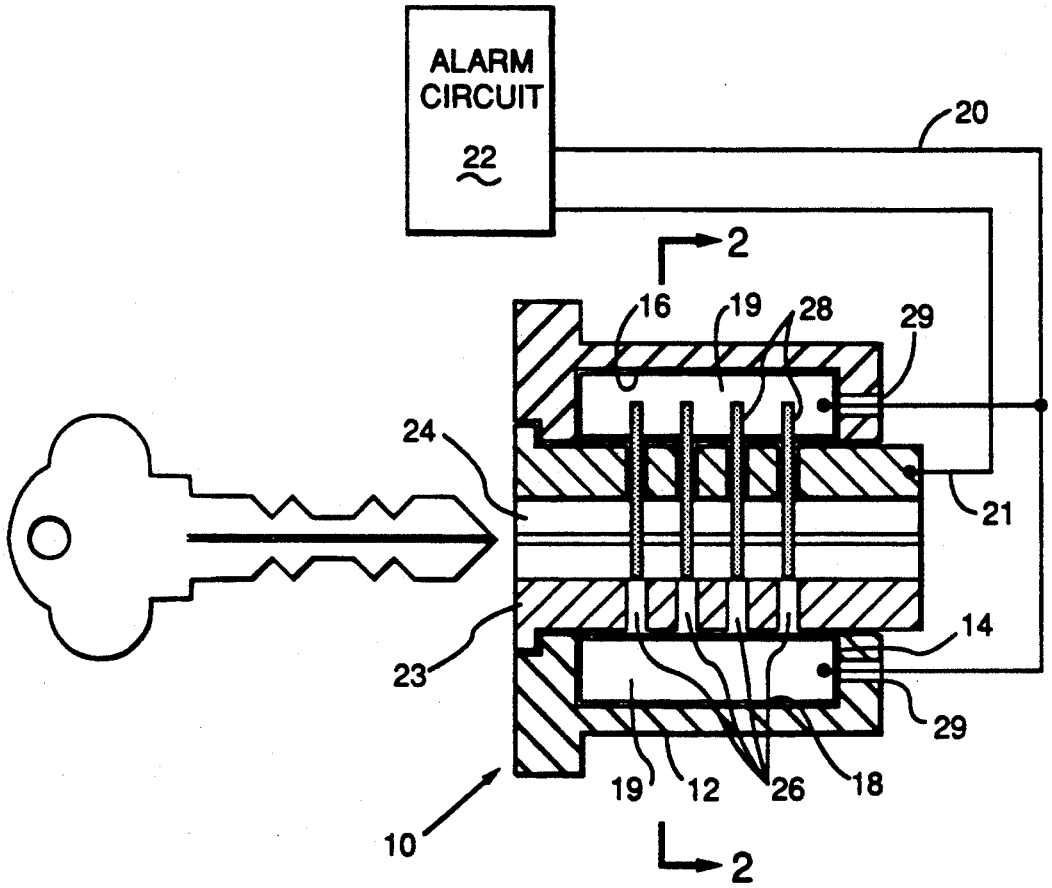
FIG. 1 is an axial cross-sectional view taken through an anti-tamper lock mechanism in accordance with the present invention shown with a schematic representation of an accompanying alarm signal circuitry and showing the key removed.

Referring now to FIG. 1 of the drawing, a conventional wafer-tumbler locking mechanism modified in accordance with the present invention is illustrated at 10. The mechanism includes a cylindrical outer housing 12 having an axial bore 14 with longitudinally extending slots 16 and 18 formed therein on opposite sides of the bore. Disposed within each slot are conductive electrodes in the form of thin metallic strips or channels 19 electrically insulated from the metallic housing 12 and jointly connected to one input 20 of an electrical alarm circuit 22. Disposed within bore 14 is a lock cylinder 23 having a key slot 24 extending longitudinally therealong and having transversely extending slots 26 forming passageways thereacross for slidably receiving wafer tumblers 28. Cylinder 23 is electrically connected to a second input 21 of alarm circuit 22

Figure 2:
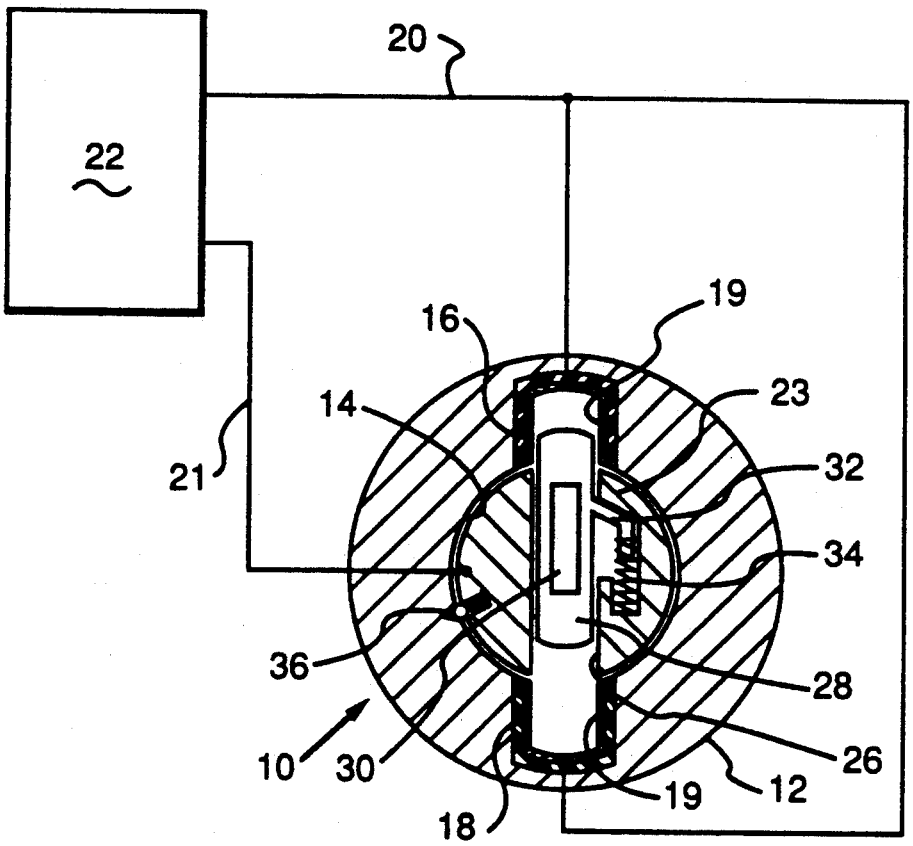
FIG. 2 is a transverse cross-sectional view taken along the line 2—2 of FIG. 1.

As is more clearly depicted in FIG. 2 of the drawing, which is a transverse cross-section taken along the line 2—2 in FIG. 1, the wafer tumblers 28 are flat, generally rectangular bodies having a key slot 30 formed therein and have a length equal to the outside diameter of cylinder 23. Each tumbler also has a laterally extending tab 32 that engages a spring 34 which serves to bias the tumbler in one direction or another such that, when the cylinder is aligned as indicated, the tumblers will extend into one of the slots 16.

Note that the transverse width of the slots 16 is substantially greater than the width of the tumblers 28, so that when the cylinder 23 is properly within its neutral position and maintained therein by a spring-loaded ball and detent-centering device shown at 36, no tumbler will engage one of the electric contact strips 19. The slots 16 and tumblers 28 otherwise interrelate in the well-known classical manner to prevent rotation of the locked cylinder 23 absent insertion of an authorized key.

In the event that one were to tamper with the lock and attempt to turn the cylinder 23 without having first inserted a key that properly retracts all of the tumblers, any unretracted tumbler will engage a contact strip 19 and complete an electrical circuit through the alarm device 22.

Figure 3:
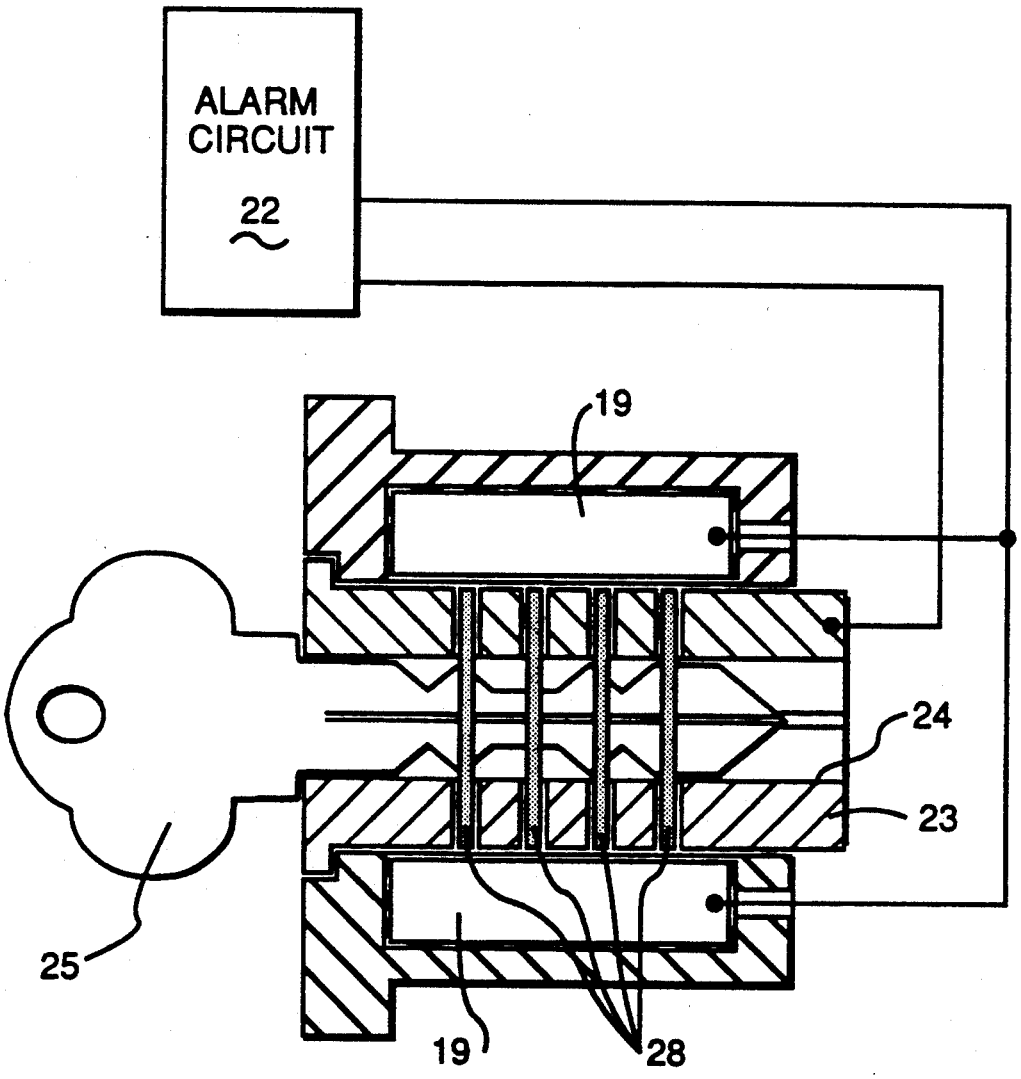
FIG. 3 is an axial cross-sectional view similar to that of FIG. 1 showing an authorized key inserted into the lock.
Figure 4:
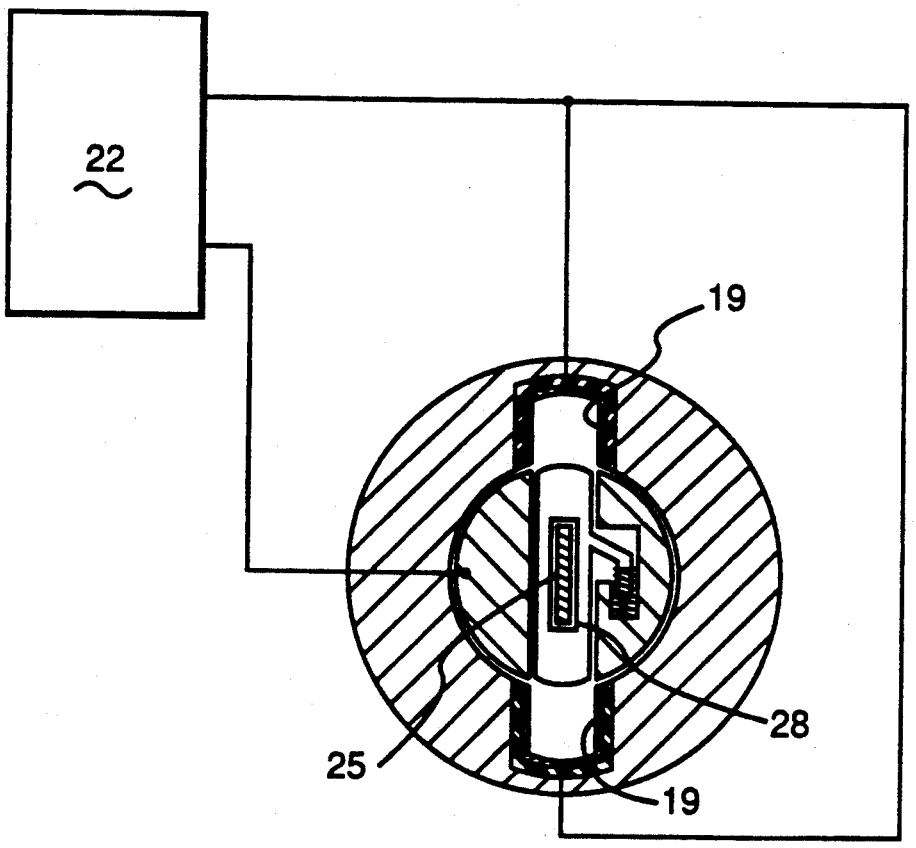
FIG. 4 is a transverse cross-sectional view taken along the line 4—4 of FIG. 3 and showing the wafer tumbler retracted by the insertion of an authorized key.

Turning now to FIG. 3 of the drawing, it will be noted that when an authorized key 25 is inserted into the keyway 24, each of the tumblers 28 is retracted into cylinder 23 and the cylinder is free to turn without sounding an alarm since no tumbler will engage an electrode 19. As indicated in FIG. 4, once retracted by an authorized key 25 inserted through the openings 28, no tumbler will project outside the outer diameter of cylinder 23 and thus cannot contact one of the electrodes 19 to set off a tamper alarm.

Note that in this type of lock the only material modification required to allow incorporation of the present invention is to increase the width of slots 16 enough to accommodate the electrodes 19 which are adhered to the slot walls by a suitable layer of insulative adhesive (FIG. 2). The electrical leads leading to electrodes 19 can be passed through small apertures 29 bored in the back side of housing 12 and aligned with each electrode end. The circuit wires can then be inserted through the apertures 29 to couple the electrodes 19 to the circuit input 20. The common or ground lead 21 may be connected to any conductive part of the housing 12 or the locking cylinder 23 so long as a conductive path is provided from the contact point to the metallic wafer tumblers 28.

Figure 5:
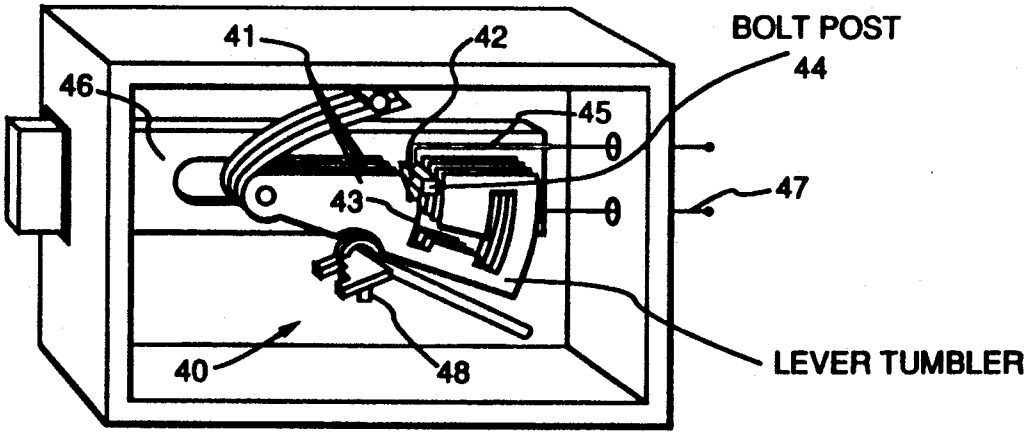
FIG. 5 is a pictorial view illustrating application of the present invention to a lever-tumbler-type lock.

Turning now to FIG. 5 of the drawing, application of the present invention to a substantially different type of locking mechanism is illustrated. In this embodiment, the present invention is incorporated in a lever-tumbler looking mechanism 40 including a plurality of tumblers 41 by simply providing an electrically isolated conductive electrode 42 along each side of the bolt post 44 with an insulated lead 45 providing a first circuit connector. A second or ground connector 47 can then be connected directly to bolt 46. Alternatively, the electrodes 42 could be positioned along the edges of the tumbler slots 43. The insertion of an unauthorized key or picking tool into the key hole 48 tending to cause the bolt 46 to move will cause the bolt post 44 to engage at least one of the tumblers 41 and actuate an alarm in a manner similar to that described earlier with regard to the embodiment of FIGS. 1-4.

It will thus be appreciated by those skilled in the art that a similar alteration of any tumbler-type, or other similar locking mechanism can be made in accordance with the present invention with similar results being enjoyed. For example, the insulated electrodes could be applied to either the slides or the locking plate of the lock to function in a manner similar to that described above so as to detect and signal a tampering attempt.

Figure 6:
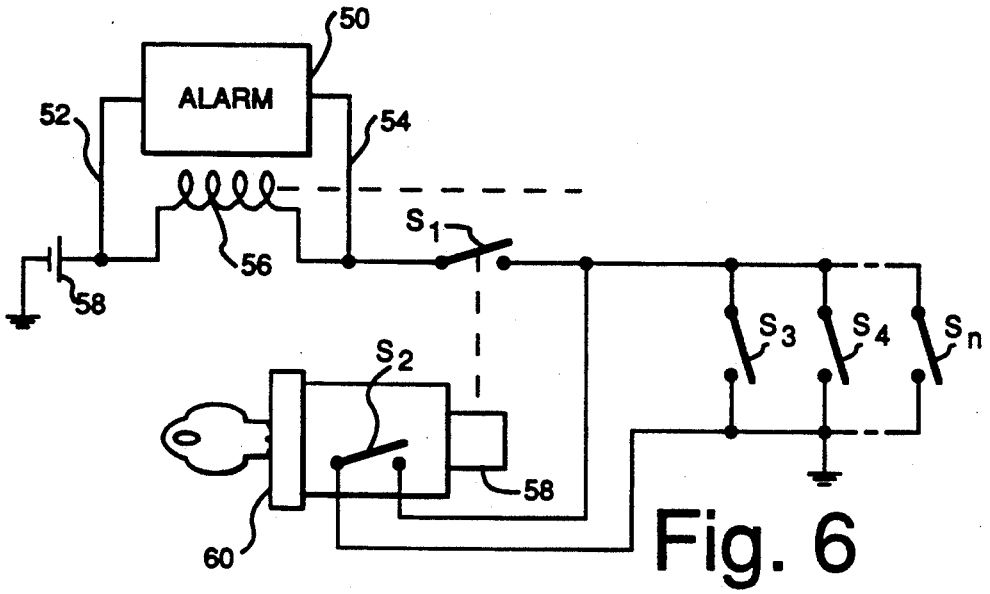
FIGS. 6 and 7 are diagrams schematically illustrating alarm systems in accordance with the present invention wherein the system-monitored switches are respectively normally open and normally closed.

Referring now to FIG. 6 of the drawing, an application of an alarm system including a locking mechanism in accordance with the present invention is depicted in this embodiment. An electrically energizable alarm means 50 is shown having input terminals 52 and 54 connected across a relay coil 56 one end of which is connected to the positive terminal of battery 58 and the other end of which is connectable to circuit ground through a plurality of switches $S_1$-$S_n$. In the illustrated embodiment, the switch $S_1$ is a normally closed switch actuated by the cylinder or functional bolt 58 of locking mechanism 60, switch $S_2$ is the internal tamper detection switch contained within locking mechanism 60 as previously disclosed, switch $S_3$ is a relay-actuated hold-on switch actuated by coil 56, and $S_4$-$S_n$ represent a plurality of switches associated with various doors, windows or event-detectors monitored by alarm 50. In this embodiment whereas $S_1$ is normally closed, switches $S_2$-$S_n$ are the normally open type of switch.

In operation with locking mechanism 60 locked, switch $S_1$ will be closed switch $S_2$ will be open, and switches $S_3$-$S_n$ will be open. In the event that anyone tampers with locking mechanism 60, switch $S_2$ will be closed connecting alarm terminal 54 to ground, thus setting off the alarm. Current flowing through coil 56 will at the same time close switch $S_3$ causing the alarm 50 to remain activated until the appropriate key is inserted into locking mechanism 60 and the bolt thereof turned to open switch $S_1$. Similarly, if a door, window or other means associated with switches $S_4$-$S_n$ should be tampered with to the extent that the associated switch was closed, alarm 50 would likewise be activated and held in the "on" condition until an appropriate key was inserted into locking mechanism 60 and switch $S_1$ opened.

Figure 7:
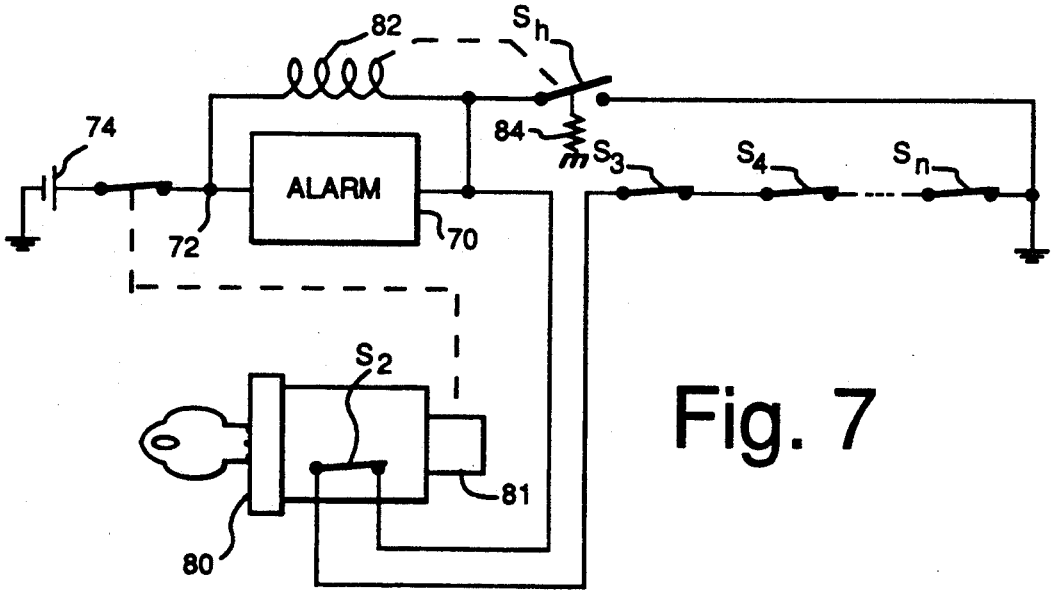

In FIG. 7, a similar application is depicted, except that in this instance alarm device 70 is of the type which is off when current flows through the system and is activated when the current flow is interrupted. More particularly, alarm terminal 72 is connected to the plus side of battery 74 through switch $S_1$ and alarm terminal 76 is connected to system ground through a series circuit including switches $S_2$-$S_n$. In this case, each of the switches $S_1$-$S_n$ are normally closed switches. In order to insure that the alarm 70 remains actuated until an appropriate key is inserted into locking mechanism 80, a spring-loaded hold-on switch $S_h$ is connected between terminal 76 and ground and is held in the "open" condition by current flow through a relay winding 82. So long as none of the switches $S_1$-$S_n$ are open, no alarm will be sounded. However, in the event that switch $S_2$ is opened by one tampering with blocking mechanism 80 or any of the switches $S_3$-$S_n$ are opened interrupting current flow through alarm 70, an alarm signal will be generated. Similarly, current flow through relay winding 82 will be interrupted, allowing spring 84 to close holding switch $S_h$ and to maintain the alarm signal until such time that the alarm is deactivated by one inserting the proper key to rotate the bolt 81 of locking mechanism 80.

Although the present invention has been disclosed with regard to only some of the many types of locking mechanisms and alarm circuit configurations, it will be appreciated that many alterations and modifications of the invention will be apparent to the skilled lock designer. It is therefore intended that the following claims be interpreted as covering all such alterations and modifications as fall within the true spirit and scope of the invention.

What is claimed is:

1. An improved alarm system comprising:
a locking mechanism including:
a fixed body;
a movable body movable relative to said fixed body and operative to perform a locking function;
a plurality of locking elements individually movable between a first position in which movement of said movable body relative to said fixed body is prevented by engagement of at least one of said locking elements with a blocking surface, and a second position in which no locking element engages said blocking surface and movement between said movable body and said fixed body is permitted;
first electrode means formed by at least one of said locking elements; and
second electrode means formed by said blocking surface, at least one of said first and second electrode means being electrically insulated from the other components of said locking mechanism;
alarm means including:
an alarm signal generator and
a plurality of event-detection sensors, said first and second electrode means forming one of said sensors, said sensors being coupled to said signal generator such that an event detected by any one of said sensors will cause said generator to develop an alarm signal; and
switching means for disabling said alarm means,
said switching means being coupled to said movable body and operable to enable said alarm means when said movable body is in a position such that said locking mechanism is locked and is operable to disable said alarm means when said movable body is in a position such that said locking mechanism is unlocked.

2. An improved alarm system as recited in claim 1 wherein said locking mechanism is of the wafer-tumbler type and said fixed body includes at least one slot the sidewalls of which carry said second electrode means in electrically insulated relationship thereof, and said movable body carries said locking elements, said locking elements normally extending into said slot to prevent movement of said movable body relative to said fixed body and simultaneously serving as said first electrode means.

3. An improved alarm system as recited in claim 2 wherein spring-loaded detect means is provided to normally maintain a rotatable cylinder forming said movable body in a predetermined position relative to said fixed body so that said locking elements normally extend into a position between portions of said second electrode means disposed adjacent the respective sidewalls of said slot but spatially separated therefrom.

4. An improved alarm system as recited in claim 1 wherein said locking mechanism is of the lever-tumbler type and wherein said blocking surface is formed by a bolt post carried by said movable body.

5. An improved alarm system as recited in claim 4 wherein said second electrode means is formed on at least one side of said bolt post.

6. An improved alarm system comprising:
a locking mechanism including:
a fixed body;
a movable body movable relative to said fixed body and operative to perform a locking function;
a plurality of tumblers individually movable between a first position in which movement of said movable body relative to said fixed body is prevented by engagement of at least one of said tumblers with a blocking surface, and a second position in which no tumbler engages said blocking surface and movement between said movable body and said fixed body is permitted;
first electrode means formed by at least one of said tumblers; and
second electrode means formed by said blocking surface, at least one of said first and second electrode means being electrically insulated from the other components of said locking mechanism;
alarm means including:
an alarm signal generator and
a plurality of event-detection sensors, said first and second electrode means forming one of said sensors, said sensors being coupled to said signal generator such that an event detected by any one of said sensors will cause said generator to develop an alarm signal; and
switching means for disabling said alarm means,
said switching means being coupled to said movable body and operable to enable said alarm means when said movable body is in a position such that said locking mechanism is locked and is operable to disable said alarm means when said movable body is in a position such that said locking mechanism is unlocked.

7. An improved alarm system comprising:
a locking mechanism including:
a fixed body;
a movable body movable relative to said fixed body and operative to perform a choking function;
a plurality of tumblers individually engageable by a key and movable thereby between a first position in which movement of said movable body relative to said fixed body is prevented by engagement of at least one of said tumblers with a blocking surface, and a second position in which no tumbler engages said blocking surface and movement between said movable body and said fixed body is permitted;
first electrode means formed by at least one of said tumblers; and
second electrode means formed by said blocking surface, at least one of said first and second electrode means being electrically insulated from the other components of said locking mechanism;
alarm means including:
an alarm signal generator and
a plurality of event-detection sensors, said first and second electrode means forming one of said sensors, said sensors being coupled to said signal generator such that an event detected by any one of said sensors will cause said generator to develop an alarm signal; and
switching means for disabling said alarm means,
said switching means being coupled to said movable body and operable to enable said alarm means when said movable body is in a position such that said locking mechanism is locked and is operable to disable said alarm means when said movable body is in a position such that said locking mechanism is unlocked.

8. An improved alarm system as recited in claim 7 wherein said locking mechanism is of the wafer-tumbler type and said fixed body includes at least one slot the sidewalls of which carry said second electrode means in electrically insulated relationship thereto, and said movable body carrier said tumblers, said tumblers normally extending into said slot to prevent movement of said movable body relative to said fixed body and simultaneously serving as said first electrode means.

9. An improved locking mechanism as recited in claim 8 wherein spring-loaded detent means is provided to normally maintain a rotatable cylinder forming said movable body in a predetermined position relative to said fixed body so that said tumblers normally extend into a position between portions of said second electrode means disposed adjacent the respective sidewalls of said slot but spatially separated therefrom.

10. An improved alarm system as recited in claim 7 wherein said locking mechanism is of the lever-tumbler type and wherein said blocking surface is formed by a bolt post carried by said movable body.

11. An improved alarm system as recited in claim 10 wherein said second electrode means is formed on at least one side of said bolt post.

* * * * *